US009247795B2

(12) United States Patent
Kim

(10) Patent No.: US 9,247,795 B2
(45) Date of Patent: Feb. 2, 2016

(54) CASE HAVING A SHOCK ABSORBING STRUCTURE FOR ELECTRONIC DEVICES

(71) Applicant: Dae-Young Kim, Seoul (KR)

(72) Inventor: Dae-Young Kim, Seoul (KR)

(73) Assignee: SPIGEN KOREA CO., LTD., Geumcheon-Gu, Seoul (KR)

( * ) Notice: Subject to any disclaimer, the term of this patent is extended or adjusted under 35 U.S.C. 154(b) by 76 days.

(21) Appl. No.: 14/201,548

(22) Filed: Mar. 7, 2014

(65) Prior Publication Data

US 2015/0001104 A1 Jan. 1, 2015

(30) Foreign Application Priority Data

Jun. 28, 2013 (KR) ..... 10-2013-0075673
Aug. 16, 2013 (KR) ..... 10-2013-0097105

(51) Int. Cl.
*B65D 85/00* (2006.01)
*A45C 11/00* (2006.01)

(52) U.S. Cl.
CPC ..... *A45C 11/00* (2013.01); *A45C 2011/002* (2013.01); *A45F 2200/0516* (2013.01)

(58) Field of Classification Search
CPC ..... H04M 1/04; H04M 1/185; H04M 1/0274; A45C 11/00; A45C 2011/002
USPC ..... 206/320, 305; 455/575.1, 575.8; 361/679.34, 679.36
See application file for complete search history.

(56) References Cited

U.S. PATENT DOCUMENTS

D606,305 S * 12/2009 Lee ..... D3/269
8,623,494 B2 * 1/2014 Richardson ..... H04B 1/3888 206/521
8,655,422 B2 * 2/2014 Stiehl ..... B29C 45/1676 361/730
2005/0139498 A1 * 6/2005 Goros ..... H04B 1/3888 206/320
2007/0184781 A1 * 8/2007 Huskinson ..... H04M 1/185 455/42
2012/0018325 A1 * 1/2012 Kim ..... A45C 11/00 206/320
2012/0305422 A1 * 12/2012 Vandiver ..... H04M 1/185 206/320

* cited by examiner

*Primary Examiner* — Chun Cheung
(74) *Attorney, Agent, or Firm* — East West Law Group; Heedong Chae

(57) ABSTRACT

The present invention relates to a case having a shock absorbing structure for an electronic device which includes a protective shell, a side enclosure frame, and a shock absorbing block. The shock absorbing block is constructed to have a plurality of recesses formed on the side wall of the protective shell such that adjacent recesses are separated by a partition. The recesses are rectangular and the plurality of recesses has a continuous unitary construction along lower part of the four sides of the protective shell. In addition, the side enclosure frame includes an upper protrusion and a lower protrusion, formed on an inner-facing surface of the side enclosure frame. The side wall of the protective shell includes an upper cavity and a lower cavity. The upper protrusion fits within the upper cavity and the lower protrusion fits within the lower cavity.

9 Claims, 10 Drawing Sheets

CASE HAVING A SHOCK ABSORBING STRUCTURE FOR ELECTRONIC DEVICES

CROSS-REFERENCE TO RELATED APPLICATIONS

This application claims the benefit of Korean Application No. 10-2013-0075673, filed on Jun. 28, 2013, with the Korean Intellectual Property Office, and Korean Application No. 10-2013-0097105, filed on Aug. 16, 2013, with the Korean Intellectual Property Office, the contents of which are incorporated herein by reference.

FIELD OF THE INVENTION

The present invention relates to a case having a shock absorbing structure for an electronic device and, more particularly, to a mobile phone case having a shock absorbing structure which is configured to have a plurality of shock absorbing recesses.

BACKGROUND OF THE INVENTION

Portable electronic devices, such as mobile phones, smart phones, tablet computers and the like, have become popular and widely used for communication, entertainment purposes and other purposes. These electronic devices are intended to be carried or moved about and as such, these devices are more likely to be accidentally dropped, hit, or scratched.

Protective cases are used in connection with the electronic devices such as cell phones, smart phones, tablet computers and the like. Due to the sensitive nature of these electronic devices, it is desirable to provide protection for these devices from impacts.

Among many types of mobile phones, bar type mobile phones have recently become very popular. Bar type mobile phones commonly have the screen and keypad on a single face. This structure of bar type mobile phones has made them particularly vulnerable to damages from being dropped or hit into.

Therefore, to solve the above problems, a need for a case having a shock absorbing structure for an electronic device has been present for a long time considering the expansive demands in the everyday life. This invention is directed to solve these problems and satisfy the long-felt need.

SUMMARY OF THE INVENTION

The present invention contrives to solve the disadvantages of the prior art. The present invention provides a case having a shock absorbing structure for an electronic device.

The object of the invention is to provide a case having a shock absorbing structure for an electronic device which includes a protective shell, a side enclosure frame, and a shock absorbing block. The protective shell protects the electronic device installed therein without significantly covering a front portion of the electronic device and the side enclosure frame is configured to removably mount over the side wall of the protective shell. The shock absorbing block is constructed to have a plurality of recesses formed on the side wall of the protective shell such that adjacent recesses are separated by a partition.

Another object of the invention is to provide a case having a shock absorbing structure for an electronic device which includes a protective shell, a side enclosure frame, and a shock absorbing block. The shock absorbing block is constructed to have a plurality of recesses formed on the side wall of the protective shell such that adjacent recesses are separated by a partition. The recesses are rectangular and the plurality of recesses has a continuous unitary construction along lower part of the four sides of the protective shell.

Still another object of the invention is to provide a case for an electronic device which comprises a protective shell and a side enclosure frame. The side wall of the protective shell has an upper ledge outwardly extending from a top of the side wall and a lower ledge outwardly extending from a bottom of the side wall. The side enclosure frame includes an upper protrusion, formed on an upper part of an inner-facing surface of the side enclosure frame, and a lower protrusion formed on a lower part of an inner-facing surface of the side enclosure frame. The side wall of the protective shell includes an upper cavity, formed immediately beneath the upper ledge, and a lower cavity, formed on the lower ledge. The upper protrusion fits within the upper cavity and the lower protrusion fits within the lower cavity.

Still another object of the invention is to provide a case having a shock absorbing structure for an electronic device wherein a shock absorbing recess is formed at an inner corner where two inner-facing surfaces of adjacent side walls of the case meet. The shock absorbing recess is formed longitudinally along the inner corner and the shock absorbing recess tapers toward a recess bottom.

The advantages of the present invention are: (1) the case for an electronic device of the present invention has a two-part structure of a protective shell and a side enclosure frame and the protective shell has a shock absorbing structure to efficiently absorb impacts from outside; (2) in addition to the shock absorbing function, the shock absorbing recesses receive protrusions of the side enclosure frame for a secure engagement of the side enclosure frame with the protective shell; (3) the lower ledges of the side wall of the protective shell not just help secure engagement of the side enclosure frame with the protective shell, but also allow the impact to the case to spread toward the shock absorbing structure; (4) the shock absorbing structure of the present invention is configured to effectively absorb impacts to the case; (5) the groove pattern formed on the protective shell prevents slipping of a mobile phone and supplements the shock absorbing function; (6) in another embodiment of the present invention, the case includes a shock absorbing recess formed at the corner of the side wall and the shock absorbing recess at the corner absorbs and distributes impact to the corner of the case to the side walls; (7) the shock absorbing recess at the corner of the side wall tapers towards its recess bottom and its inlet is rounded, and thus, the shock absorbing recess bends or crooks to absorb and distribute the impact to the case to the side walls of the case; and (8) the concave and/or convex structure of the shock absorbing recess helps improve the shock absorbing or distributing function of the recess.

Although the present invention is briefly summarized, the fuller understanding of the invention can be obtained by the following drawings, detailed description and appended claims.

BRIEF DESCRIPTION OF THE DRAWINGS

These and other features, aspects and advantages of the present invention will become better understood with reference to the accompanying drawings, wherein.

DETAILED DESCRIPTION EMBODIMENTS OF THE INVENTION

Reference will now be made in detail to the preferred embodiments of the present invention, examples of which are illustrated in the accompanying drawings, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention.

Also, as used in the specification including the appended claims, the singular forms "a", "an", and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about", it will be understood that the particular value forms another embodiment.

Figure 1:
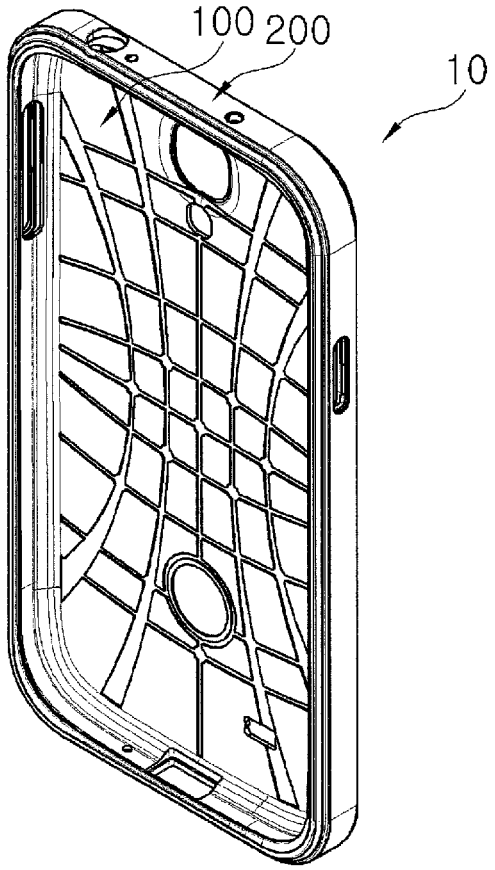
FIG. 1 shows a perspective view of a case having a shock absorbing structure for an electronic device according to one embodiment of the present invention.
Figure 2:
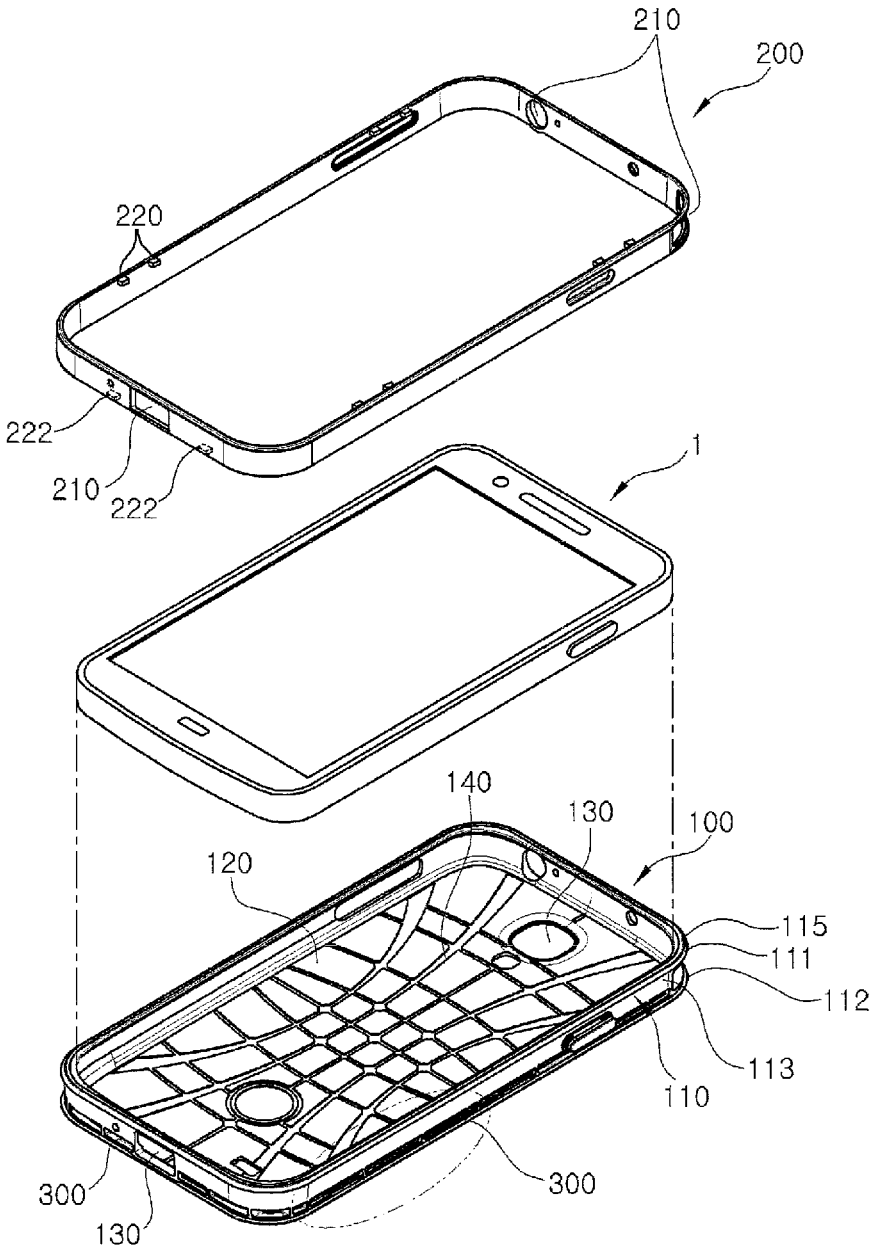
FIG. 2 shows an exploded view of the case having a shock absorbing structure for an electronic device shown in FIG. 1.
Figure 3:
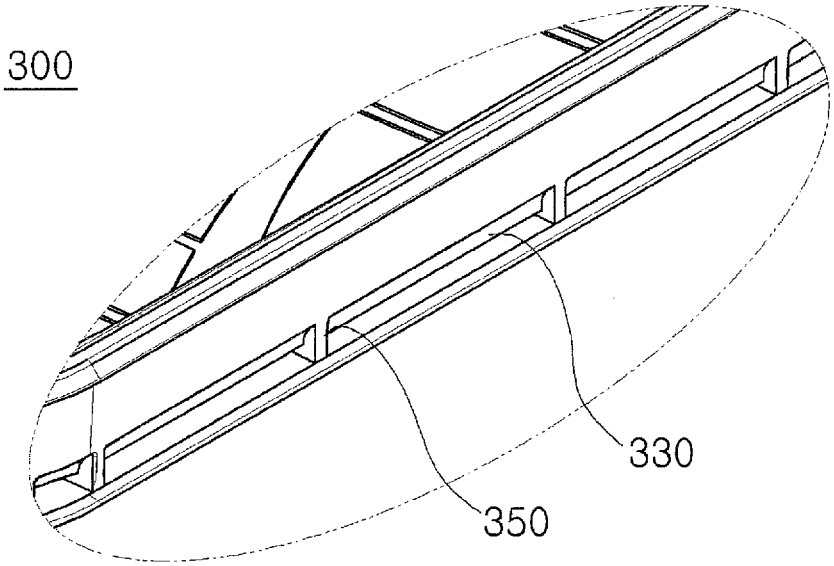
FIG. 3 shows a partial view of the side wall of the protective shell illustrating the shock absorbing structure according to one embodiment of the present invention.

FIGS. 1 and 2 respectively show perspective and exploded views of the case 10 having a shock absorbing structure 300 for an electronic device 1 according to one embodiment of the present invention. FIG. 3 shows the shock absorbing structure 300 formed on the side wall 110 of the case 10.

The case 10 having a shock absorbing structure 300 for an electronic device 1 includes a protective shell 100, a side enclosure frame 200, and a shock absorbing block 300. The protective shell 100 protects the electronic device 1 installed therein without significantly covering a front portion of the electronic device 1. The protective shell 100 has a bottom wall 120 to cover a bottom portion of the electronic device 1, and a side wall 110 extending from the bottom wall 120 to cover side portions of the electronic device 1. The side enclosure frame 200 is configured to removably mount over the side wall 110 of the protective shell 100 and the shock absorbing block 300 is constructed to have a plurality of recesses 330 formed on the side wall 110 such that adjacent recesses 330 are separated by a partition 350.

Preferably, the protective shell 100 is made of soft, elastic or ductile materials, such as soft plastic or rubber, to absorb shock or impact to the electronic device 1 whereas the side enclosure frame 200 is made of hard materials, such as metal, hard plastic or synthetic resin, to compress the sides of the electronic device 1. Polycarbonates are recommended as a material for the side enclosure frame 200 because they are easily worked, molded, and thermoformed.

The protective shell 100 receives an electronic device 1 therein and the elastic side enclosure frame 200 tightly holds sides 110 of the protective shell 100 and the electronic device 1. Accordingly, the side wall 110 of the protective shell 100 is snugly engaged and/or compressed between the electronic device 1 and the side enclosure frame 200.

Preferably, the recesses 330 are rectangular as shown in FIG. 3 and the plurality of recesses 330 has a continuous unitary construction along the four sides of the side wall 110.

The partition 350 prevents the recess 330 from vertically compressed and allows shock or impact to the case to be absorbed and distributed throughout the whole shock absorbing structure 300. The partition 350 between the recesses 330 is preferably shorter than the width of the recess 330.

Figure 4:
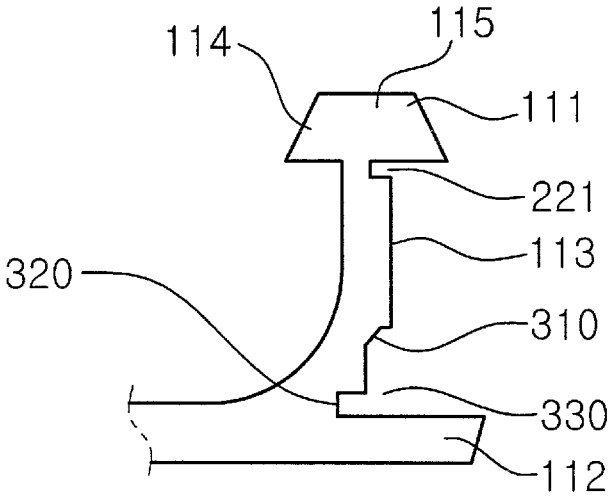
FIG. 4 shows a partial cross-sectional view of the side wall of the protective shell illustrating the shock absorbing structure according to one embodiment of the present invention.

FIG. 4 shows a partial cross-sectional view of the side wall 110 illustrating the shock absorbing structure 300 according to one embodiment of the present invention.

The side wall 110 includes a first upper ledge 111 outwardly extending from a top 115 of the side wall 110 and a lower ledge 112 outwardly extending from a bottom of the side wall 110 such that the first upper ledge 111, the lower ledge 112, and the side wall 110 form a groove 113 to receive the side enclosure frame 200.

The lower ledges 112 not just help secure engagement of the side enclosure frame 200 with the protective shell 100, but also allow the impact to the case to spread toward the shock absorbing structure 300.

The side wall 110 further includes a second upper ledge 114 inwardly extending from the top 115 of the side wall 110 to engage outer edges of the front portion of the electronic device 1.

Preferably, the first upper ledge 111, the second upper ledge 114, and the lower ledge 112 are formed substantially continuously and unitarily along the four sides of the side wall 110. However, the continuous structure may be partially interrupted by other elements such as openings 210, 130 formed on the protective shell 100 or the side enclosure frame 200. The openings 210, 130 are formed on the locations corresponding to the locations of buttons, headset jack, microphone, speaker, camera or electrical connectors of the electronic device 1.

Figure 5:
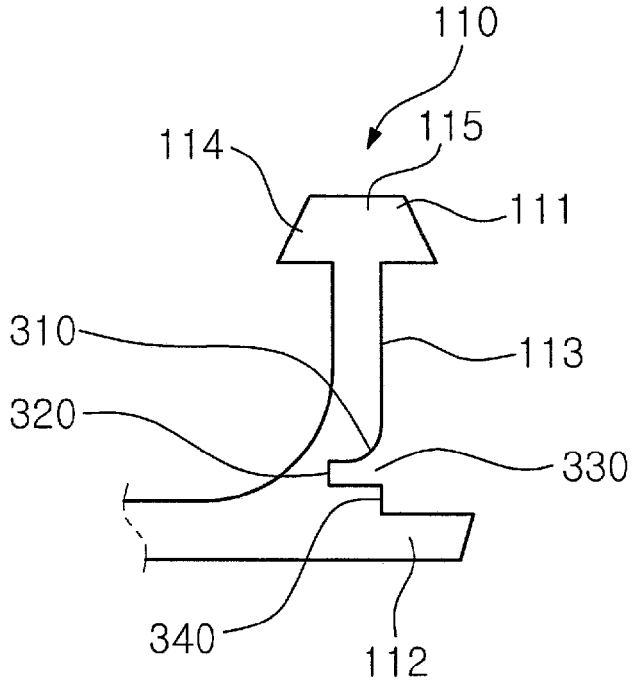
FIG. 5 shows a partial cross-sectional view of the side wall of the protective shell illustrating the shock absorbing structure according to another embodiment of the present invention.

The lower ledge 112 may be outwardly extended longer than the first upper ledge 111 as shown in FIGS. 4 and 5, or alternatively the extended length of the lower ledge 112 and the first upper ledge 111 may be substantially the same. The lower ledge 112 prevents the side enclosure frame 200 from slipping.

The edges of the first upper ledge 111, the second upper ledge 114, and/or the lower ledge 112 are beveled or rounded to prevent damages such as scratch to an electronic device user.

The lower part of the side wall 110 is preferably thicker than an upper part of the side wall 110 because the lower part of the inner-facing surface of the side wall is rounded to conform to a corresponding part of the electronic device 1 as shown in FIGS. 4 and 5. Because of this structure, it is better for the recesses 330 of the shock absorbing block 300 to be aligned along a lower part of the side wall 110.

FIGS. 4-7 show partial cross-sectional views of the side wall 110 illustrating various configurations of the recesses 330.

The recess 330 may taper inwardly towards a recess bottom 320. The recesses 330 may be formed immediately on the lower ledge 112 as in FIG. 4 or there may be a step 340 between the recess 330 and the lower ledge 112 as in FIGS. 5, 6 and 7. The step 340 helps the shock absorbing structure 300 better absorb impacts than the structure 300 without it.

Figure 6:
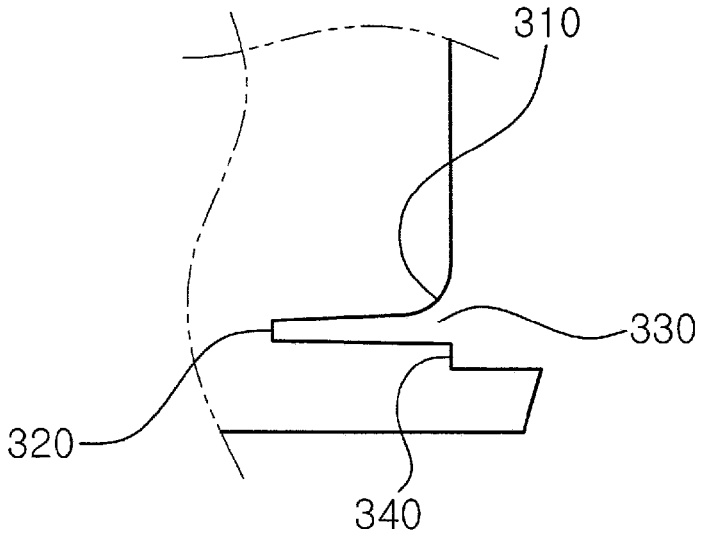
FIG. 6 shows a partial cross-sectional view of the side wall of the protective shell illustrating the shock absorbing structure according to still another embodiment of the present invention.
Figure 7:
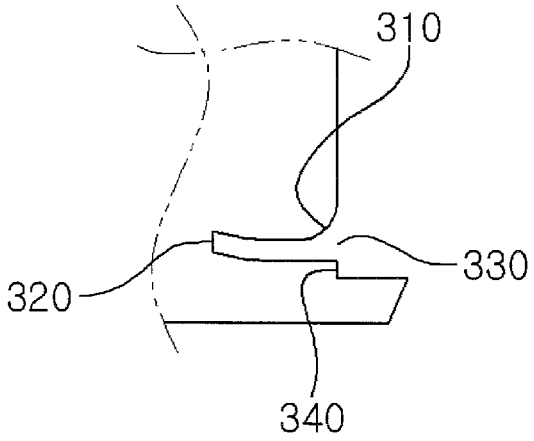
FIG. 7 shows a partial cross-sectional view of the side wall of the protective shell illustrating the shock absorbing structure according to still another embodiment of the present invention.

The recess 330 may further include an upper entering portion 310 which is beveled as in FIG. 4 or rounded as in FIGS. 5, 6, and 7. Beveled or rounded entering portion 310 prevents the recess 330 from being vertically compressed and collapsed and allows impact to the case 10 to move inwardly. Furthermore, the recess 330 may be curved slightly upwardly toward the recess bottom 320. This curved configuration is advantageous in better distributing shocks or impacts to the case 10 throughout the shock absorbing structure 300.

The side enclosure frame 200 may further include an upper protrusion 220 and a lower protrusion 222 as in FIG. 2. Preferably, a plurality of upper protrusions 220 are formed on an upper part of an inner-facing surface of the side enclosure frame 200 and the side wall 110 of the protective shell 100 includes the plurality of cavities 221 which are formed immediately beneath the first upper ledge 111. Each of the upper protrusion 220 fits within the corresponding cavity 221. Accordingly, the length of the cavity 221 needs to be long enough to receive the upper protrusion 220.

The lower protrusion 222 is formed on a lower part of an inner-facing surface of the side enclosure frame 200 and the lower protrusion 222 fits within the recess 330.

As shown in FIGS. 1 and 2, the bottom wall 120 of the protective shell 100 may include a pattern of grooves 140 for absorbing shocks from impact. The groove pattern 140 formed on the protective shell 100 prevents slipping of a mobile phone 1 and supplements the shock absorbing function. In addition, the grooves 140 can be designed in a variety of ways to create aesthetically pleasing looks.

In one embodiment of the present invention, the case 10 for an electronic device 1 comprises a protective shell 100 that protects the electronic device 1 installed therein without significantly covering a front portion of the electronic device 1, and a side enclosure frame 200 configured to removably mount over the side wall 110 of the protective shell 100. The protective shell 100 includes a bottom wall 120 to cover a bottom portion of the electronic device 1, and a side wall 110 extending from the bottom wall 120 to cover side portions of the electronic device 1. The side wall 110 has an upper ledge 111 outwardly extending from a top 115 of the side wall 110 and a lower ledge 112 outwardly extending from a bottom of the side wall 110 such that the upper ledge 111, the lower ledge 112, and the side wall 110 form a groove 113 to receive the side enclosure frame 200. Furthermore, the side enclosure frame 200 includes an upper protrusion 220, formed on an upper part of an inner-facing surface of the side enclosure frame 200, and a lower protrusion 222 formed on a lower part of an inner-facing surface of the side enclosure frame 200. In addition, the side wall 110 includes an upper cavity 221, formed immediately beneath the upper ledge 111, and a lower cavity 330, formed on the lower ledge 112. The upper protrusion 220 fits within the upper cavity 221 and the lower protrusion 222 fits within the lower cavity 330.

Figure 8:
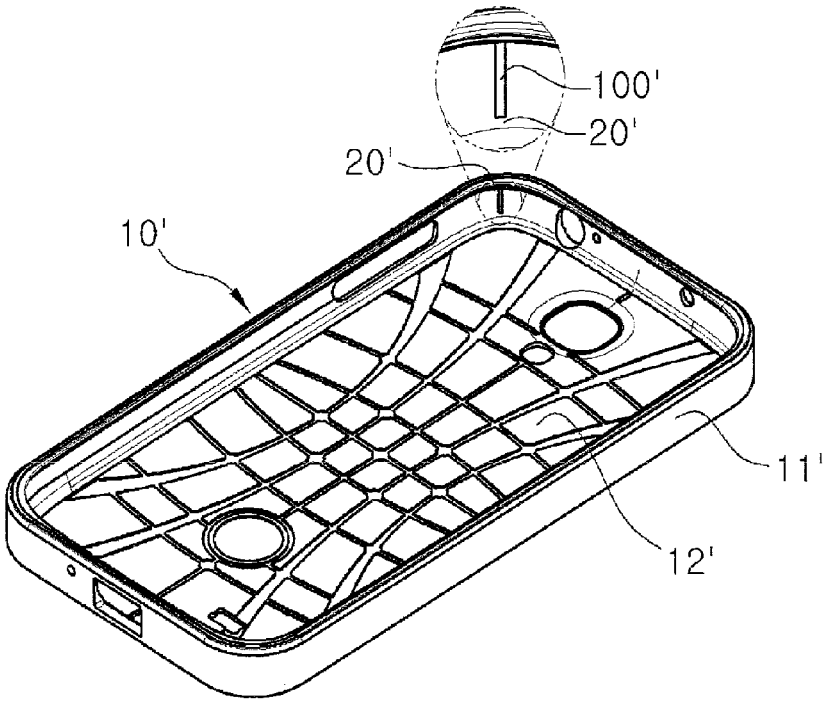
FIG. 8 shows a perspective view of a case having a shock absorbing recess for an electronic device according to another embodiment of the present invention.
Figure 9:
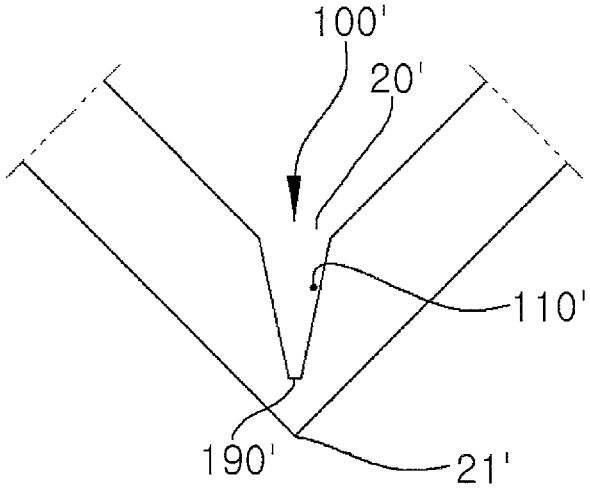
FIG. 9 shows a partial cross-sectional view of the side wall of the case illustrating one embodiment of the shock absorbing recess shown in FIG. 8.

FIG. 8 shows another embodiment of the present invention. The case 10' has a shock absorbing structure in the form of a shock absorbing recess 100' formed at an inner corner 20' of the side wall 11'.

The case 10' having a shock absorbing structure for an electronic device includes a bottom wall 12' to cover a bottom portion of the electronic device, four side walls 11' extending from the bottom wall 12' to cover four side portions of the electronic device, and a shock absorbing recess 100' formed at an inner corner 20' where two inner-facing surfaces of adjacent side walls 11' meet.

The case 10' is preferably made of elastic materials such as plastic, rubber, silicon or the like.

As shown in FIG. 8, the shock absorbing recess 100' is formed longitudinally along the inner corner 20'. The recess 100' may be formed at the center about 0.3~0.7 cm apart from the top and/or bottom of the inner corner 20', or it may be formed to cover substantially all line from the top to the bottom of the inner corner 20'.

FIGS. 9-13 show partial cross-sectional views of the side wall 11' of the case 10' illustrating various embodiments of the shock absorbing recess 100'.

Generally, the shock absorbing recess 100' tapers toward a recess bottom 190'. This tapering configuration of the recess 100' allows impacts to the case 10' to move and distribute towards the side walls 11' rather than towards the inner corner 20' and then towards the corner of an electronic device. Accordingly, the configuration of the recess 100' allows impacts to the case 10' to spread and be absorbed at wider area of the side walls 11', instead of the impacts concentrating on the corner 20' and resulting in damages to the electronic device.

The recess bottom 190' may be rounded to prevent it from be torn apart, and the inlet 130' of the recess 100' may be beveled or rounded for better distribution of impacts.

Figure 10:
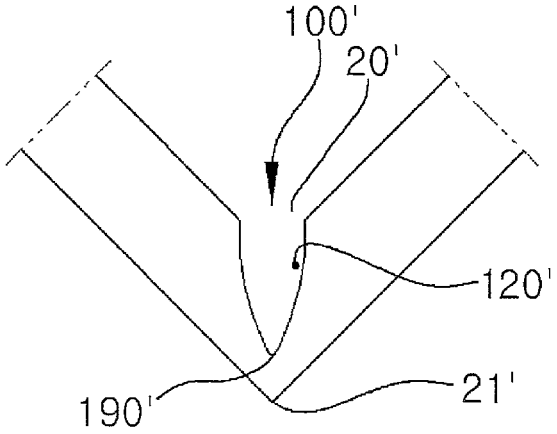
FIG. 10 shows a partial cross-sectional view of the side wall of the case illustrating another embodiment of the shock absorbing recess shown in FIG. 8.
Figure 11:
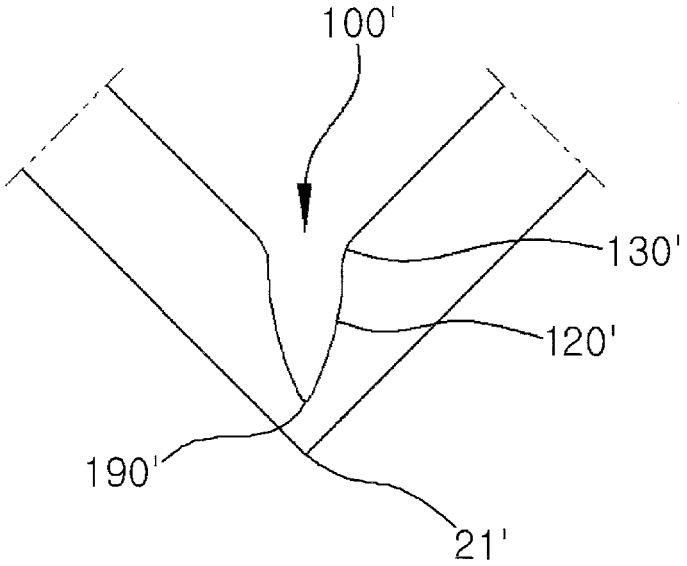
FIG. 11 shows a partial cross-sectional view of the side wall of the case illustrating still another embodiment of the shock absorbing recess shown in FIG. 8.
Figure 12:
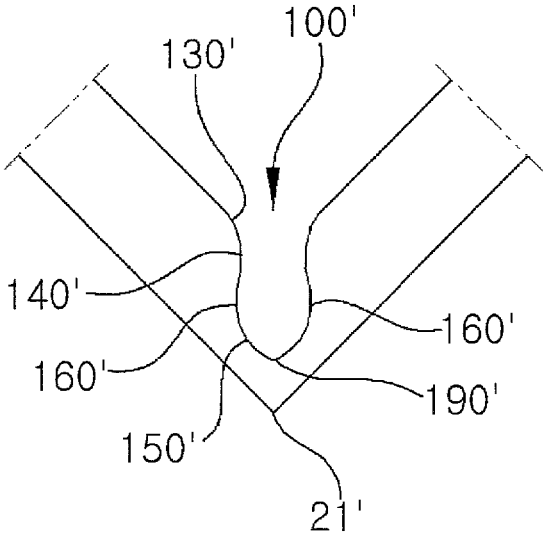
FIG. 12 shows a partial cross-sectional view of the side wall of the case illustrating still another embodiment of the shock absorbing recess shown in FIG. 8.

As in FIG. 10, the shock absorbing recess 100' may be concavely curved toward the recess bottom 190'. As shown in FIGS. 11 and 12, an inlet 130' of the shock absorbing recess 100' may be rounded.

In FIG. 11, the shape of the shock absorbing recess 100' may conform to the inverted normal distribution graph.

In FIG. 12, the shock absorbing recess 100' convexly tapers and then, passing an inflection point 160', concavely tapers toward the recess bottom 190'. The convex and/or concave curve may conform to the curve of a quadratic function. By this configuration, the impact to the case 10' first moves and distributes through the concave curve and then, the impact is fast absorbed at around the inlet 130'. Due to the time delay between the impact spread and the impact absorption, the shock absorbing recess 100' can effectively protect the electronic device.

Figure 13:
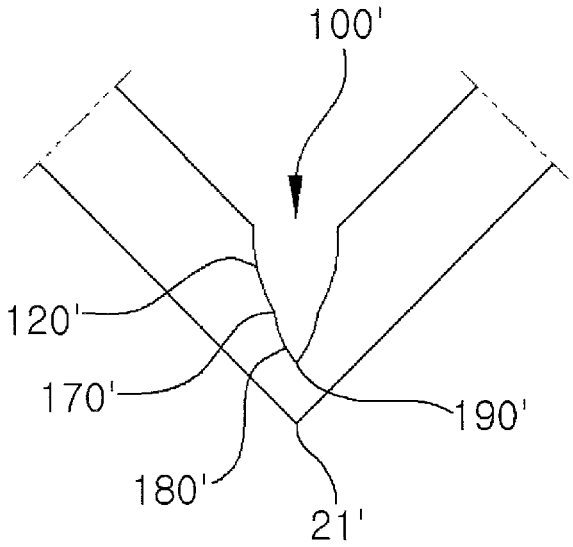
FIG. 13 shows a partial cross-sectional view of the side wall of the case illustrating still another embodiment of the shock absorbing recess shown in FIG. 8.

In FIG. 13, the shock absorbing recess 100' concavely tapers toward the recess bottom 190, but the shock absorbing recess 100' has a first concave portion 120' and a second concave portion 180'. The two concave portions 120', 180' border at an injunction 170'. The first and second concave portions 120', 180' may conform to the shape of quadratic functions. By this configuration, impacts to the electronic device are first absorbed at the second concave portion 180' and then spread and distribute through the first concave portion 120'.

While the invention has been shown and described with reference to different embodiments thereof, it will be appreciated by those skilled in the art that variations in form, detail, compositions and operation may be made without departing from the spirit and scope of the invention as defined by the accompanying claims.

What is claimed is:

1. A case having a shock absorbing structure for an electronic device, comprising:

a protective shell that protects the electronic device installed therein without significantly covering a front portion of the electronic device, wherein the protective shell comprises:

a bottom wall to cover a bottom portion of the electronic device; and a side wall extending from the bottom wall to cover a side portion of the electronic device;

a side enclosure frame configured to removably mount over the side wall of the protective shell; and a shock absorbing block, having a plurality of recesses formed on the side wall, wherein adjacent recesses are separated by a partition, wherein a lower part of the side wall is thicker than an upper part of the side wall, wherein the recesses of the shock absorbing block are aligned along a lower part of the side wall.

2. The case of claim 1, wherein the side wall comprises a first upper ledge outwardly extending from a top of the side wall and a lower ledge outwardly extending from a bottom of the side wall wherein the first upper ledge, the lower ledge, and the side wall form a groove to receive the side enclosure frame.

3. The case of claim 2, wherein the side wall further comprises a second upper ledge inwardly extending from the top of the side wall to engage outer edges of the front portion of the electronic device.

4. The case of claim 2, wherein the lower ledge is outwardly extended longer than the first upper ledge.

5. The case of claim 2, wherein the side enclosure frame comprises an upper protrusion formed on an upper part of an inner-facing surface of the side enclosure frame and the side wall of the protective shell comprises a cavity formed immediately beneath the first upper ledge, and wherein the upper protrusion fits within the cavity.

6. The case of claim 1, wherein the recesses are formed immediately on the lower ledge.

7. The case of claim 1, wherein the side enclosure frame comprises a lower protrusion formed on a lower part of an inner-facing surface of the side enclosure frame wherein the lower protrusion fits within the recess.

8. A case having a shock absorbing structure for an electronic device, comprising:

a protective shell that protects the electronic device installed therein without significantly covering a front portion of the electronic device, wherein the protective shell comprises:

a bottom wall to cover a bottom portion of the electronic device; and a side wall extending from the bottom wall to cover a side portion of the electronic device;

a side enclosure frame configured to removably mount over the side wall of the protective shell; and a shock absorbing block, having a plurality of recesses formed on the side wall, wherein adjacent recesses are separated by a partition, wherein the recesses taper inwardly towards a recesses bottom, wherein the recesses further comprise an upper entering portion which is beveled.

9. The case of claim 1, wherein the bottom wall of the protective shell comprises a pattern of grooves for absorbing shocks from impact.

* * * * *